United States Patent [19]

Kawase

[11] Patent Number: 4,932,095

[45] Date of Patent: Jun. 12, 1990

[54] FACE WASHING PUFF

[76] Inventor: Yuichi Kawase, 144 Uguisudai, Nagaokakyo-shi, Kyoto 617, Japan

[21] Appl. No.: 172,541

[22] PCT Filed: Jun. 11, 1987

[86] PCT No.: PCT/JP87/00376

§ 371 Date: Apr. 25, 1988

§ 102(e) Date: Apr. 25, 1988

[87] PCT Pub. No.: WO88/00015

PCT Pub. Date: Jan. 14, 1988

[30] Foreign Application Priority Data

Jun. 26, 1986 [JP] Japan ..... 61-98772

[51] Int. Cl.[5] ..... A47K 7/02

[52] U.S. Cl. ..... 15/227; 139/396; 2/167

[58] Field of Search ..... 15/227; 139/396; 604/292, 289, 290; 2/158, 16, 20, 164, 167

[56] References Cited

U.S. PATENT DOCUMENTS

| | | | |
|---|---|---|---|
| 1,521,935 | 1/1925 | Elwell | 15/227 |
| 1,999,753 | 4/1935 | Diemer | 15/227 |
| 2,151,448 | 3/1939 | Steinberg | 15/227 |
| 2,431,433 | 11/1947 | Solakian et al. | 15/227 |
| 2,505,409 | 4/1950 | Kirchner | 15/227 |
| 2,569,067 | 9/1951 | Livshin | 15/227 |
| 4,071,921 | 2/1978 | Jury | 15/227 |
| 4,089,069 | 5/1978 | Vistins | 2/167 |
| 4,457,640 | 7/1984 | Anderson | 15/227 |

*Primary Examiner*—John Weiss
*Assistant Examiner*—Adriene J. Lepiane
*Attorney, Agent, or Firm*—Morgan & Finnegan

[57] ABSTRACT

The face washing puff of the invention is constructed in the form of a bag body (2) so that it can be used by inserting fingers in its opening (1). A double-faced pile fabric (3) is used on the working surface and this double-faced pile fabric (3) has a dense cut pile (4) on one surface and a loop pile (5) on the other surface. Since the arrangement is such that the cut pile (4) is positioned on the outer side of the bag body (2), the front end of the cut pile (40 is applied to the skin; thus, it can be used conveniently and provides an effective cleaning effect.

6 Claims, 1 Drawing Sheet

FACE WASHING PUFF

TECHNICAL FIELD

This invention relates to a face washing puff produced with the use of cotton pile fabrics.

BACKGROUND ART

Among known face washing puffs used for cleaning the face is sponge or sponge covered with cloth, and in washing the face, such puff with soap or the like applied thereto is rubbed against the face to remove the dirt and makeup. It is also known to wash the face by a similar method using a small-sized brush having hairs or the like set therein, called a face washing brush. With such method, though effective in removing the dirt on the face, it has been impossible to bring the skin into a moist smooth state.

The so-called skin troubles, such as greasy skin, dry skin, pimples, eruptions, stains, freckles, dark skin and fine wrinkles, are caused by keratin incrassation. Generally, keratin, when stimulated, tends to incrassate, and keratin gradually incrassates under the influences of remnants of cosmetics and ultraviolet rays. To keep the skin beautiful, therefore, it is necessary to stop the proceeding of incrassation and remove the unnecessary portion of the keratin deposited on the skin.

The conventional face wasing methods, However, fail to remove the stubborn keratin, resulting in cleaning only the surface of the outermost layer of the skin; thus, they have been unable to remake the skin beautiful.

Thus, the use of a rigid, face washing brush and a toilet soap having fine sand powder mixed therein has been tried; however, the use of these items excessively removes the keratin, failing to retain a layer of keratin of given thickness on the skin, and has the drawback of causing inflammation to the skin, being unsuitable for the delicate skin of the face.

The present invention has for its object the provision of a face washing puff which eliminates the drawbacks of such conventional face washing appliances, accelerates normal keratin metabolism and, while maintaining a given thickness of keratin layer on the surface, regenerates a white smooth skin, reviving the old skin to provide a clear skin similar to the baby's.

DISCLOSURE OF THE INVENTION

The present invention achieves the intended object very effectively by providing a face washing puff in the form of a bag body adapted to receive fingers in its opening, at least the working surface thereof being formed of a cotton double-faced pile fabric.

The double-faced pile fabric which forms the working surface of the face washing puff of the present invention has a dense cut pile on one side and a loop pile on the other side; the invention is characterized in that the cut pile surface is positioned on the outer side of the bag body.

Such puff of the invention is constructed as a bag body and can be used by inserting fingers into its opening; therefore, it is very easy to use. Further, since the working surface of the puff is formed of a cotton pile fabric superior in moisture absorption, it is agreeable to the touch and provides a satisfactory face washing effect. Further, since its outer surface is formed of a dense cut pile of cotton, it can uniformly act also on tiny recessed and raised spots on the skin, thus increasing the cleaning effect. Moreover, since the working surface is formed of a double-faced pile fabric, it develops an elastic cushion effect which enhances the action of the cut pile of the surface on the skin.

In the present invention, a single layer of such double-faced pile fabric may be used to form the working surface, in which case since the loop pile is exposed on the inner side of the bag body, the fingers inserted in the bag body touch the loop pile, enabling the puff to be operated stably and with a good feel. Further, in use, such layer of double-faced pile fabric may be combined with at least another layer of pile fabric; particularly, it is preferable that two or more layers of said double-faced pile fabric be laminated to form a working surface in such a manner that the upper loop pile contacts the lower cut pile.

In the case where two or more layers of double-faced pile fabric having a dense cut pile on one surface and a loop pile on the other surface are laminated in such a manner that the cut pile of the upper layer pile fabric is exposed on the outer side of the bag body and the loop pile of the lower layer pile fabric is exposed on the inner side of the bag body, the two pile fabrics are stably laminated, without causing a shift, by the entwining between the cut pile and loop pile on the contact surfaces of the two pile fabrics and by their friction; as a result, there is obtained a product which is very easy to use and which is soft, more elastic and highly cleaning-effective.

The cut pile exposed on the outer side of the bag body should preferably be finished by shearing. Generally, the cut pile of the double-faced pile fabric should be trimmed so that its length is 0.2–2 mm, preferably about 0.5–1 mm.

Further, the bag body should preferably be formed so that its outer periphery substantially forms a U shape; usually, it is formed by sewing the periphery of two sheets. In this case, it is preferable that at least one of the two sheets be formed of a double-faced pile fabric or a laminate thereof as described above.

The surface other than the working surface, for example, one surface of the bag body may be formed of any sheet, such as an ordinary woven fabric or a synthetic film; however, in order that both surfaces of the bag body may be used, it is preferable to form the entire bag body of a double-faced pile fabric. In addition, if the sheets are sewn together so that there is more or less shift between the sheets, it becomes easier to distinguish the working surface in use and to handle the bag body.

BEST MODE OF EMBODYING THE INVENTION

Figure 1:
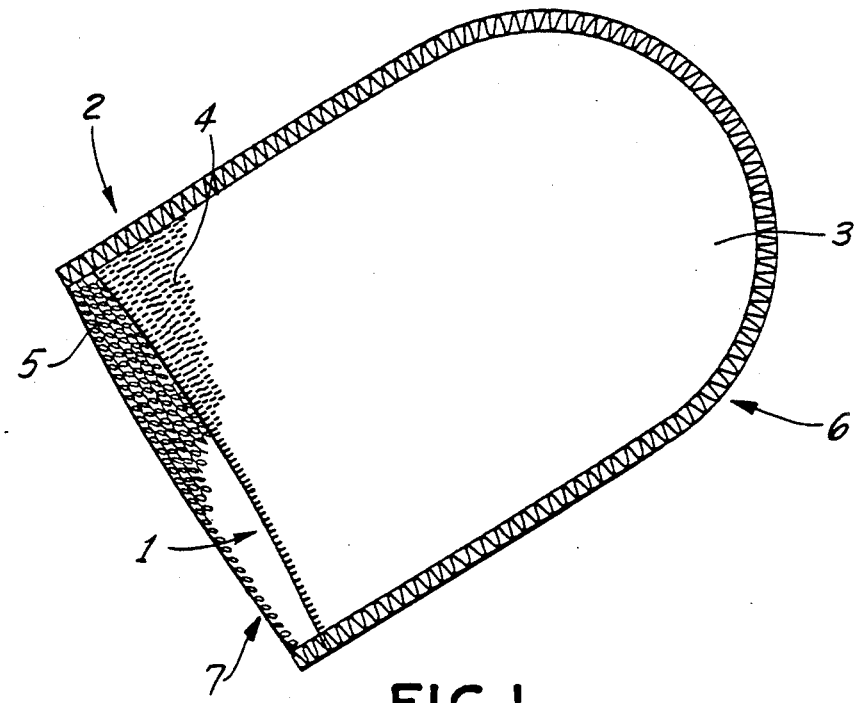
FIG. 1 is a perspective view of an example of the puff of the invention.

Embodiments of the invention will now be described with reference to the drawing.

A puff shown in FIG. 1 comprises two sheets (6) and (7), U-shaped, each about 11 cm long and about 8 cm wide, and sewn together around the periphery to form a bag body (2) having an opening (1) at the linear top, said sheets (6) and (7) each being a cotton pile fabric (3) having a 0.5 mm-long cut pile (4), finished by shearing, on one surface and a loop pile (5) on the other surface.

Figure 2:
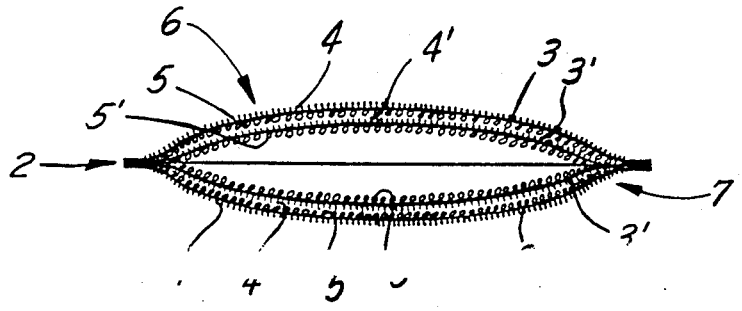
FIG. 2 is a sectional view showing another example of the puff of the invention.

Further, a puff shown in FIG. 2 comprises sheets (6) and (7) each in the form of two layers of cotton double-faced pile fabric (3) and (3').

The double-faced pile fabrics (3) and (3') each have a cut pile (4), (4'), finished by shearing, on one surface and a loop pile (5), (5') on the other surface, and they are laminated with the loop pile (5) of the upper layer pile fabric (3) opposed to the cut pile (4') of the lower layer pile fabric (3') so that the loop pile (5') is positioned inside the bag body.

In addition, in these puffs, the sheets (6) and (7) are sewn together so that a shift forms in the opening (1) to make it easier to insert fingers in the opening (1) and to identify the surface being used.

These puffs are used by inserting three fingers, the index finger, middle finger and medical finger, into the opening (1). In use, after the makeup has been removed or subsequent to the usual face washing, toilet soap is applied to the wetted cut pile (4) surface or a face washing foam is applied to the face and then the cut pile (4) surface is directly applied to the face. In each case, it can be used with the force suitably adjusted by the insertion of three fingers. The presence of the loop pile (5) or (5') positioned inside the bag body ensures that it feels good to the touch and is stably held in a given position; thus, the puff is easy to handle.

In addition, in each of the examples shown in FIGS. 1 and 2, the face can be washed with front end of the dense cut pile (4) brought into uniform contact with the skin with a soft touch and the incrassated keratin portion can be smoothly removed while preventing excessive peeling of the keratin; the dirt in the pores of the skin a in the intercellular grooves can be effectively removed to regenerate a clear smooth skin.

In the example shown in FIG. 2, the presence of the loop pile (5) and cut pile (4') on the lamination surfaces of the double-faced pile fabrics (3) and (3') enables the cut pile (4) surface to be applied uniformly and stably to the skin, thus ensuring higher face-washing effect.

Generally, sufficient face washing effect can be attained with such puff by applying its working surface to the face and moving it back and forth at a rate of 3 strokes per second.

Further, since the front end of the bag body (2) is arcuate, the washing of such delicate areas as those around the eyes can be very smoothly effected.

What is claimed:

1. A face washing puff characterized in that it is constructed in the form of a bag body for use by inserting fingers into its opening at least its working surface is formed of a lamination of cotton double-faced pile fabrics, each of said double-faced pile fabrics having a dense cut pile on one surface and a loop pile on the other surface, said double-faced fabrics being laminated with the loop pile of the upper layer pile fabric brought into contact with the cut pile of the lower layer pile fabric so that the loop pile of the lower layer pile fabric is exposed on the inner side of the bag body.

2. A face washing puff as set forth in claim 1, characterized in that the cut pile exposed on the outer side of the bag body is finished by shearing.

3. A face washing puff as set forth in claim 1, characterized in that the cut pile is trimmed to a given length of 0.2–2 mm.

4. A face washing puff as set forth in claim 1, characterized in that the outer periphery of the bag body is substantially U-shaped.

5. A face washing puff as set forth in claim 1, characterized in that the bag body is formed by sewing two sheets around the periphery thereof, at least one of said sheets being a lamination of said double-faced pile fabrics.

6. A face washing puff as set forth in claim 5, characterized in that each of said sheets is formed of a lamination of said double-faced pile fabrics, the bag body being formed by sewing said sheets together so that at the opening there is a shift between the sheets.

* * * * *

UNITED STATES PATENT AND TRADEMARK OFFICE

CERTIFICATE OF CORRECTION

PATENT NO. : 4,932,095

DATED : June 12, 1990

INVENTOR(S) : Yuichi Kawase

It is certified that error appears in the above-identified patent and that said Letters Patent is hereby corrected as shown below:

On the title page, item 57, under the legend "Abstract", line 9, "the cut pile (40" should correctly read -- the cut pile (4) --.

In Col. 1, line 28, "However," should read -- however, --.

In Col. 3, line 33, "skin a" should read -- skin and --.

Signed and Sealed this

Twelfth Day of May, 1992

*Attest:*

DOUGLAS B. COMER

*Attesting Officer*

*Acting Commissioner of Patents and Trademarks*